US010130171B2

(12) United States Patent
Olson et al.

(10) Patent No.: US 10,130,171 B2
(45) Date of Patent: Nov. 20, 2018

(54) INSULATED TRANSPORT CABINETS FOR FOOD AND THE LIKE

(71) Applicant: InterMetro Industries Corporation, Wilkes-Barre, PA (US)

(72) Inventors: Jeffrey C. Olson, Dallas, PA (US); Todd Robinson, Nazareth, PA (US)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 0 days.

(21) Appl. No.: 15/427,325

(22) Filed: Feb. 8, 2017

(65) Prior Publication Data

US 2018/0220791 A1 Aug. 9, 2018

(51) Int. Cl.
*A47B 31/00* (2006.01)
*E05D 11/00* (2006.01)
(Continued)

(52) U.S. Cl.
CPC ..... *A47B 31/00* (2013.01); *E05C 3/122* (2013.01); *E05C 3/145* (2013.01); *E05D 1/00* (2013.01);
(Continued)

(58) Field of Classification Search
CPC ... A47B 31/00; A47B 2013/002; A47B 47/04; A47B 96/201; A47B 81/00; B62B 3/004;
(Continued)

(56) References Cited

U.S. PATENT DOCUMENTS 2,727,547 A * 12/1955 Moon ..... A45C 11/22 206/269
3,082,903 A * 3/1963 Stevens ..... B65D 43/162 220/833
(Continued)

FOREIGN PATENT DOCUMENTS

EP 2966000 A1 * 1/2016 ..... B65D 43/021
WO WO-2010139737 A1 * 12/2010 ..... B65B 7/2878
WO WO-2016152049 A1 * 9/2016

OTHER PUBLICATIONS

"Half-Height Heated Transport Cabinets* TC90 FlavorHold™ Series" InterMetro [Catalog], InterMetro Industries Corporation, Oct. 2011, two pages.
(Continued)

*Primary Examiner* — Andrew M Roersma
(74) *Attorney, Agent, or Firm* — Harness, Dickey & Pierce, P.L.C.

(57) ABSTRACT

The present disclosure provides an insulated transport cabinet for food or the like having a housing, a door, a hinge cover, and a hinge pin. The housing includes a barrel portion adjacent to a front surface and extending between top and bottom ends. The barrel portion includes a longitudinal axis, a gap separating the barrel portion into top and bottom barrel sections having first and second passageways aligned with the longitudinal axis, respectively. The door includes a hinge adjacent to a side surface and including a third passageway aligned with the longitudinal axis. An inner surface of the hinge pin complements an outer surface of the hinge. The hinge pin passes through the first, third, and second passageways. The door pivots about the longitudinal axis between an open position and a closed position. The longitudinal axis is offset from a center plane of the door.

11 Claims, 10 Drawing Sheets

(51) Int. Cl.

| | |
|---|---|
| ***E05D 3/02*** | (2006.01) |
| ***E05D 5/12*** | (2006.01) |
| ***E05D 1/00*** | (2006.01) |
| ***E05D 7/10*** | (2006.01) |
| ***E05C 3/12*** | (2006.01) |
| ***E05C 3/14*** | (2006.01) |

(52) U.S. Cl.
CPC ..... *E05D 3/02* (2013.01); *E05D 5/12* (2013.01); *E05D 7/1077* (2013.01); *E05D 11/0054* (2013.01); *A47B 2031/002* (2013.01); *E05Y 2900/20* (2013.01)

(58) Field of Classification Search
CPC ..... B62B 2202/67; B62B 2501/065; B65D 45/32; B65D 45/327; B65D 43/22; B65D 43/00; B65D 43/0204; B65D 43/0206; B65D 43/021
USPC ..... 49/499.1; 220/834, 833, 835
See application file for complete search history.

(56) References Cited

U.S. PATENT DOCUMENTS

| | | | | | |
|---|---|---|---|---|---|
| 3,149,747 | A * | 9/1964 | Burgess | B65D 43/0204 | 220/284 |
| 4,014,456 | A * | 3/1977 | Echtle | A45C 11/20 | 206/558 |
| 4,060,173 | A * | 11/1977 | Dahl | B65D 1/34 | 220/4.23 |
| 5,312,011 | A * | 5/1994 | Fischer | B65D 21/022 | 206/508 |
| 5,584,408 | A * | 12/1996 | Orkisz | B65D 43/162 | 220/4.22 |
| D393,128 | S | 3/1998 | Maddux | | |
| 5,791,473 | A * | 8/1998 | Decker | B65D 43/021 | 206/316.1 |
| 6,986,434 | B1 | 1/2006 | Getsy et al. | | |
| D573,400 | S | 7/2008 | Olson | | |
| D637,373 | S | 5/2011 | Benning et al. | | |
| D647,751 | S | 11/2011 | Olson | | |
| 8,322,553 | B2 * | 12/2012 | Rider, Jr. | B65D 43/021 | 220/203.09 |
| D767,230 | S | 9/2016 | Olson | | |
| 2003/0155365 | A1 * | 8/2003 | Llorente Lecue | B65D 43/021 | 220/802 |
| 2004/0124200 | A1 * | 7/2004 | Yuhara | A45D 33/006 | 220/833 |
| 2005/0023304 | A1 | 2/2005 | Vogel et al. | | |
| 2006/0070814 | A1 * | 4/2006 | Hu | B62B 5/00 | 186/45 |
| 2013/0270988 | A1 * | 10/2013 | Nicholson | A47B 81/00 | 312/400 |
| 2015/0377542 | A1 | 12/2015 | Lee et al. | | |
| 2016/0370082 | A1 * | 12/2016 | Olivo | F25D 3/06 | |

OTHER PUBLICATIONS

"Metro C5 3 Series Insulation Armour™ Heated Holding and Proofing Cabinets" InterMetro [Catalog], InterMetro Industries Corporation, May 2012, two pages.
"Metro C5 4 Series Insulation Armour™ Plus Transport Cabinets" InterMetro [Catalog], InterMetro Industries Corporation, May 2016, two pages.
"Metro C5 T-Series Transport Armour™ Heavy-Duty Heated Holding Cabinet" InterMetro [Catalog], InterMetro Industries Corporation, Feb. 2011, two pages.
Google image search results for "insulated food cart". Search made on Feb. 16, 2018. (https://www.google.com/search?q=insulated+food+cart&rlz=1C1GGRV_enUS768US768&source=Inms&tbm=isch&sa=X&ved=0ahUKEwjewoDW9_PYAhXB21MKHbt3BIMQ_AUICygC&biw=1536 &bih=871#imgrc=_).

* cited by examiner

INSULATED TRANSPORT CABINETS FOR FOOD AND THE LIKE

FIELD

The present disclosure relates to insulated transport cabinets for food and the like, a door mounting and sealing structure for insulated transport cabinets, and a method of assembling and disassembling insulated transport cabinets.

BACKGROUND

This section provides background information related to the present disclosure which is not necessarily prior art.

Insulated cabinets can be used, for example, to keep food hot or cold. Insulated cabinets may include wheels, or a cart having wheels, so that they can be readily transported between locations. An insulated transport cabinet may include multiple compartments or sections. Different cabinet sections may be used to transport food of different temperatures, for example. Transport cabinets may be front-loaded, so that a hinged door is capable of pivoting between a closed position and an open position to provide access to a front compartment. Thus, transport cabinets include a body with an interior compartment, a hinged door, and a seal or gasket between the door and the body.

SUMMARY

This section provides a general summary of the disclosure, and is not a comprehensive disclosure of its full scope or all of its features.

In certain aspects, the present disclosure provides an insulated transport cabinet for food or the like. The insulated transport cabinet includes a housing, a door, a hinge cover, and a hinge pin. The housing includes a front surface, an interior compartment, and a barrel portion. The interior compartment extends into the front surface. The barrel portion is adjacent to the front surface and extends between a top end and a bottom end. The barrel portion includes a longitudinal axis, a gap, a first passageway, and a second passageway. The longitudinal axis extends through a center of the barrel portion. The gap is located intermediate the top end and the bottom end. The gap separates the barrel portion into a top barrel section and a bottom barrel section. The first passageway is in the top barrel section and it is substantially aligned with the longitudinal axis. The second passageway is in the bottom barrel section and it is substantially aligned with the longitudinal axis. The door includes a hinge adjacent to a side surface of the door. The hinge includes a third passageway substantially aligned with the longitudinal axis. The hinge cover has an inner surface that is adapted to complement an outer surface of the hinge. The hinge pin passes through the first passageway, the third passageway, and the second passageway. The door is adapted to pivot about the longitudinal axis between an open position and a closed position. A back surface of the door engages the front surface of the housing when the door is in the closed position to prevent access to the interior compartment. The door includes a center plane disposed between the back surface of the door and a front surface of the door. The center plane is substantially parallel to the front surface and the back surface. The longitudinal axis is offset from the center plane.

In some embodiments, the insulated transport cabinet also includes a first cap and a second cap. The first cap at least partially engages an inner surface of the first passageway. The second cap at least partially engages an inner surface of the second passageway. The first cap prevents the hinge pin from backing out of the top barrel section. The second cap prevents the hinge pin from backing out of the bottom barrel section.

In some embodiments, the barrel portion of the housing is integrally formed with the housing. The hinge is integrally formed with the door.

In some embodiments, the outer surface of the hinge includes a slot adjacent to the third passageway and substantially parallel to the longitudinal axis.

In some embodiments, engagement of the inner surface of the hinge cover with the outer surface of the hinge encloses the slot to maintain the door on the hinge pin.

In some embodiments, the hinge cover also includes a living hinge. The living hinge is disposed between a fixed portion of the hinge cover and a free portion of the hinge cover. The living hinge is offset from the longitudinal axis. The free portion of the hinge cover is adapted to pivot about the living hinge between a locked position and an unlocked position.

In some embodiments, the front surface of the door includes a receiver and the hinge cover includes a protrusion. The protrusion engages the receiver to fix the hinge cover to the door.

In some embodiments, the protrusion is tree-shaped.

In some embodiments, the insulated transport cabinet also includes a sealing structure. The sealing structure includes a groove and a rib. The groove extends into a peripheral wall of the interior compartment. The rib is disposed around a perimeter of the door. The rib is adjacent to the back surface of the door. The rib is shaped to complement the groove. The rib engages the groove when the door is in the closed position.

In other aspects, the present disclosure provides an insulated transport cabinet for food or the like. The insulated transport cabinet includes a housing, a door, and a latch. The housing includes a front surface and an interior compartment extending into the front surface. The door includes a first side surface, a hinge, a second side surface, and a latch slot. The hinge is adjacent to the first side surface. The second side surface is opposite the first side surface. The latch slot is included in the second side surface. The latch includes a fixed end, a free end, a stem, and a holder. The fixed end is pivotally connected to the housing. The stem extends between the fixed end and the free end. The holder is adjacent to the free end. The door is adapted to pivot between an open position and a closed position. The latch is adapted to pivot between an unlocked position and a locked position. The stem of the latch is at least partially disposed in the latch slot. A back surface of the holder engages a front surface of the door when the latch is in a locked position to maintain the door in the closed position.

In some embodiments, the insulated transport cabinet also includes a latch keeper. The latch keeper is fixed to a front surface of the door. The latch keeper includes an extension adapted to engage a receptacle in the stem of the latch. Engagement of the extension with the receptacle maintains the latch in a locked position.

In some embodiments, the door includes a recessed portion in the front surface. The latch keeper is at least partially disposed in the recessed portion.

In some embodiments, the insulated transport cabinet also includes a substantially cylindrical latch pin having first and second ends fixed to the housing. The latch includes a tubular portion adjacent to the fixed end. The tubular portion of the latch includes a passage extending along a longitudinal axis. The latch pin passes through the passage and is substantially aligned with the longitudinal axis. The latch is adapted to pivot about the longitudinal axis between the unlocked position and the locked position.

In some embodiments, the housing includes an undercut shaped to complement the latch pin. The first and second ends of the latch pin engage the undercut to maintain the latch pin in the housing.

In some embodiments, the latch comprises an elastomeric material.

In still other aspects, the present disclosure provides a door mounting and sealing structure for an insulated transport cabinet for food and the like. The door mounting and sealing structure includes a housing and a door. The housing includes an interior compartment having a peripheral wall and a first groove extending into the peripheral wall. The door includes a first side surface, a second side surface opposite the first side surface, and a back surface substantially perpendicular to the first side surface and the second side surface. The door also includes a hinge and a first rib. The hinge is adjacent to and integrally formed with the first side surface. The first rib is disposed around a perimeter of the door adjacent to the back surface. The first rib is shaped and sized to complement the first groove of the housing. The door is pivotally connected to the housing by the hinge. The door is adapted to pivot between an open position and a closed position. The first rib of the door engages the first groove of the housing when the door is in a closed position.

In some embodiments, the first rib includes a top rib, a bottom rib, and a first side rib. The top rib is disposed adjacent to a top surface of the door. The bottom rib is disposed adjacent to a bottom surface of the door. The first side rib is disposed adjacent to the first side surface of the door.

In some embodiments, each of the top rib, the bottom rib, and the first side rib includes a width and a height substantially perpendicular to the width. At least one of the width or height is tapered such that it is greater at a center than at opposing ends.

In some embodiments, both the width and the height of each of the top rib, the bottom rib, and the first side rib are tapered such that the width is greater at the center than at opposing ends and the height is greater at the center than at opposing ends.

In some embodiments, a corner of the perimeter of the door adjacent to the top surface and the second side surface includes a flat portion.

In some embodiments, a front surface of the housing includes a second groove. The back surface of the door includes a second rib. The second rib is sized and shaped to complement the second groove. The second rib is substantially parallel to the second side surface of the door. The second rib is disposed adjacent to the second surface of the door. The second rib engages the second groove when the door is in the closed position.

In some embodiments, the housing also includes a barrel portion. The barrel portion is adjacent to the front surface and extends between a top end and a bottom end. The barrel portion includes a longitudinal axis, a gap, a first passageway, and a second passageway. The longitudinal axis extends through a center of the barrel portion. The gap is located intermediate the top end and the bottom end. The gap separates the barrel portion into a top barrel section and a bottom barrel section. The first passageway is in the top barrel section and is substantially aligned with the longitudinal axis. The second passageway is in the bottom barrel section and is substantially aligned with the longitudinal axis. The hinge also includes a third passageway substantially aligned with the longitudinal axis. A hinge pin passes through the first passageway, the third passageway, and the second passageway. The door is adapted to pivot about the longitudinal axis to move between the open position and the closed position.

In some embodiments, the door includes a center plane disposed between the back surface of the door and a front surface of the door. The center plane is substantially parallel to the front surface and the back surface. The longitudinal axis is offset from the center plane.

In some embodiments, the first rib of the door and the first groove of the housing are fully disengaged when the door is pivoted greater than or equal to about 3° about the longitudinal axis from the closed position.

In some embodiments, the first groove and the first rib are configured to create a fluid-tight seal when the door is in the closed position to prevent fluid leaks.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 5A:
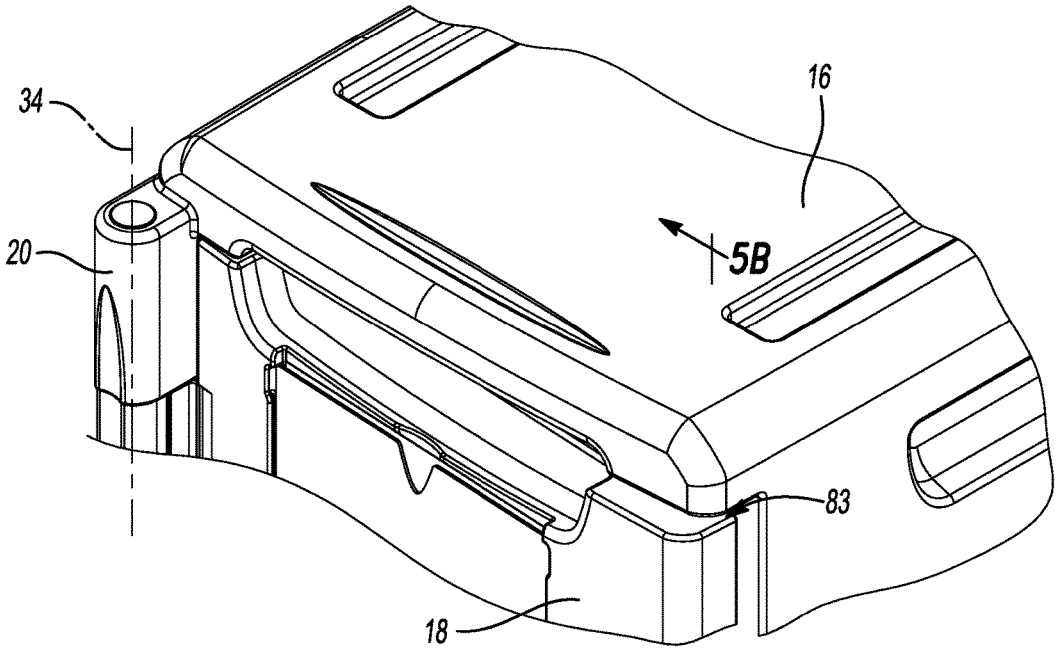
Figure 5B:
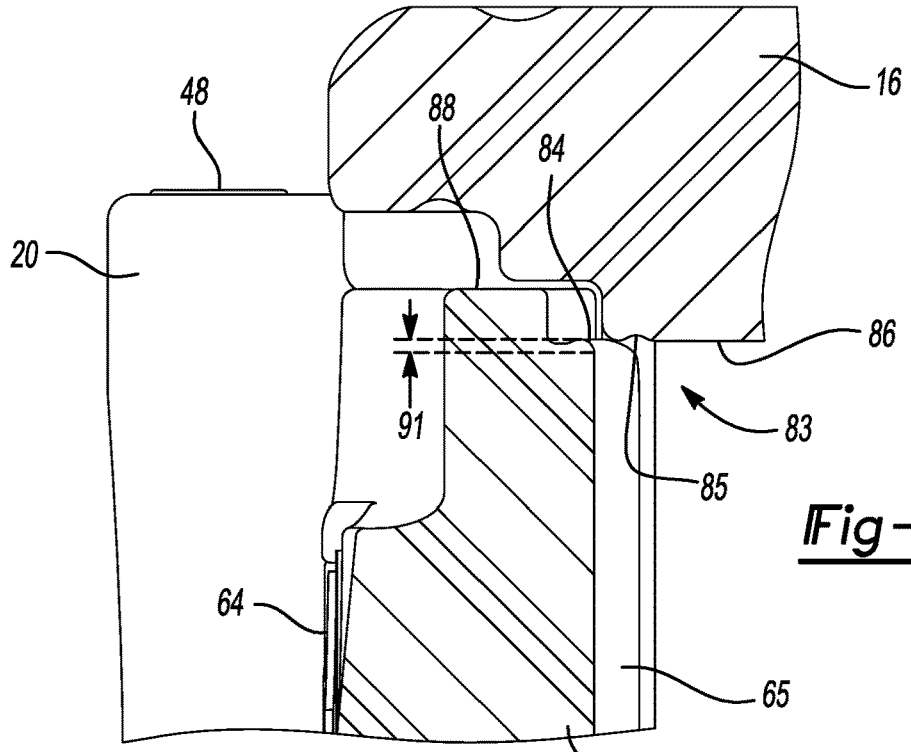
Figure 5C:
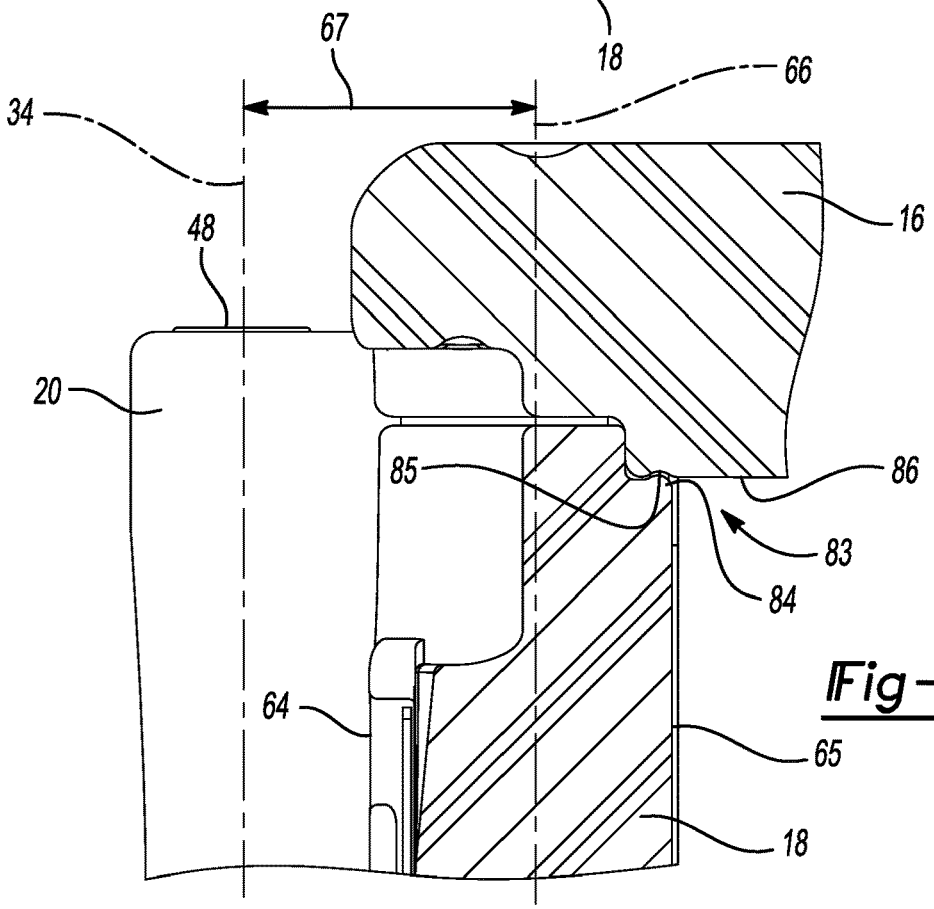
Figure 5D:
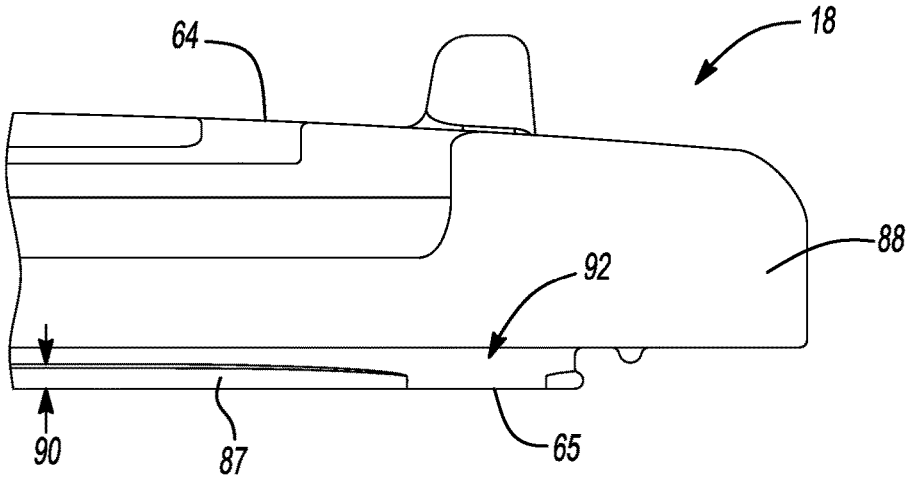
Figure 5E:
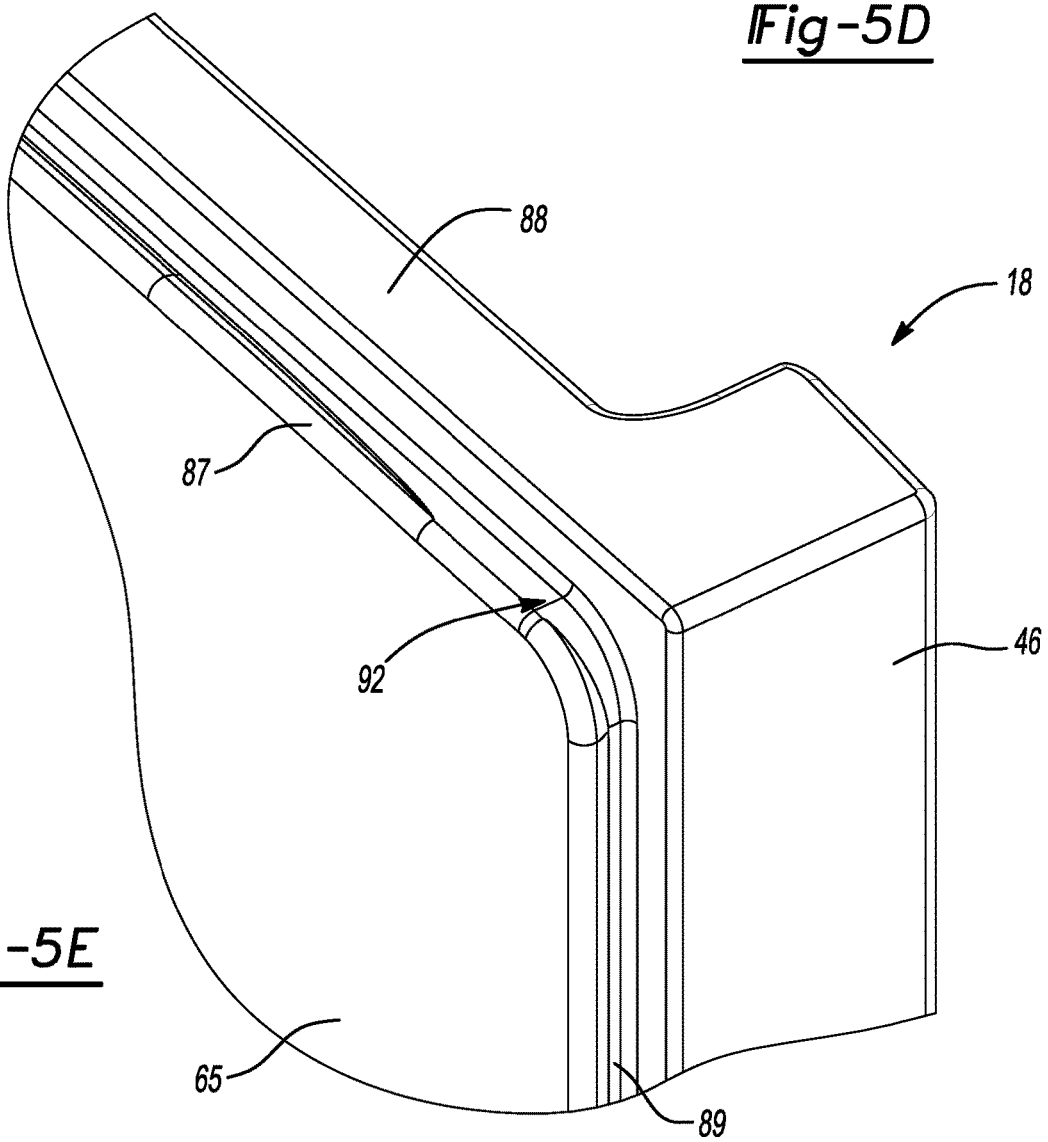
Figure 5F:
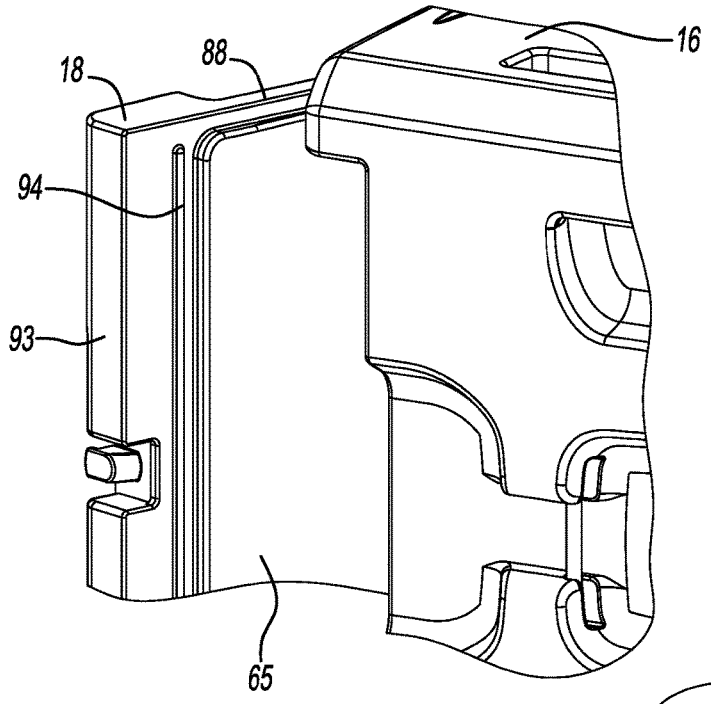
Figure 5G:
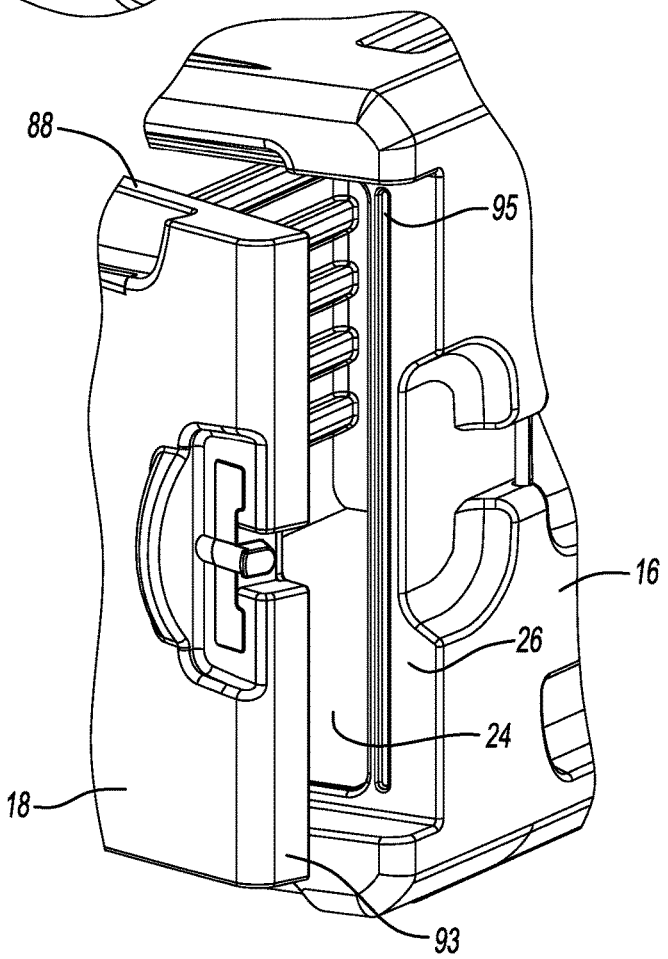
Figure 6A:
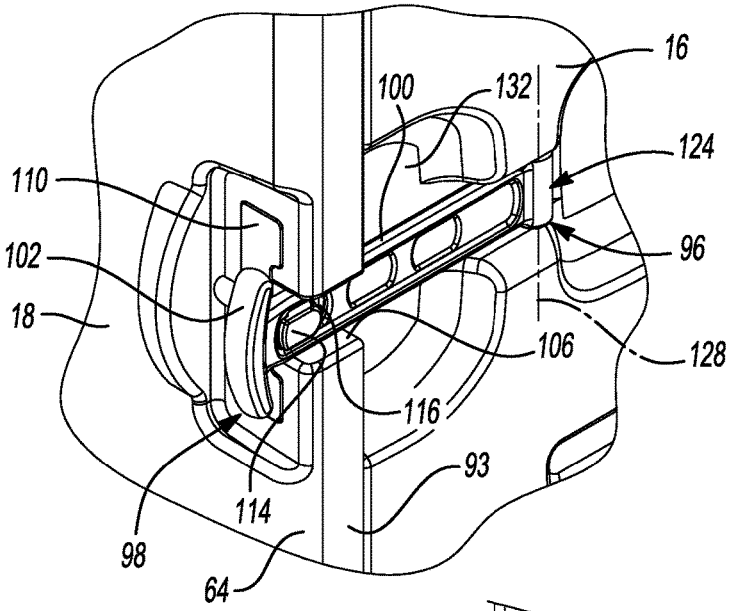
Figure 6B:
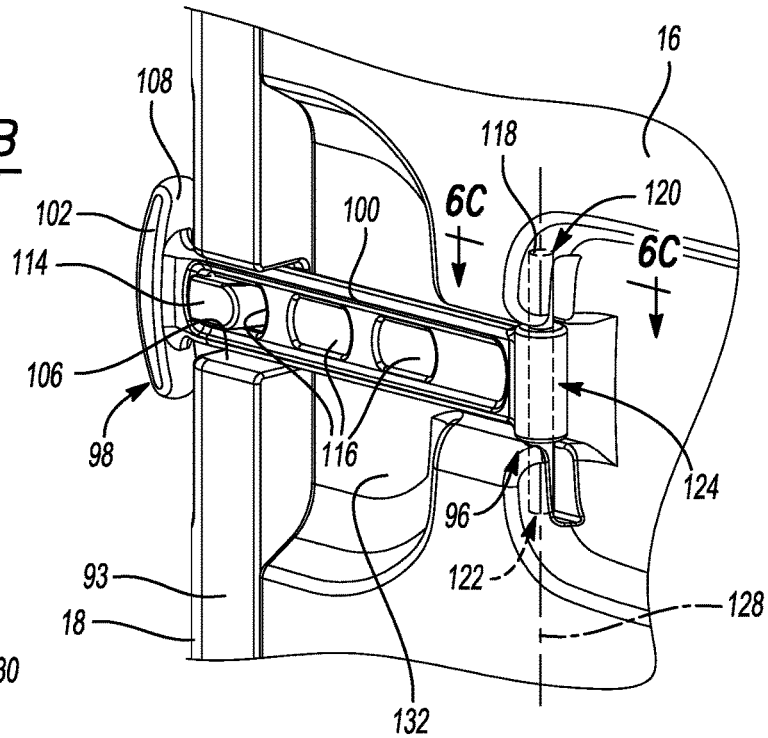
Figure 6C:
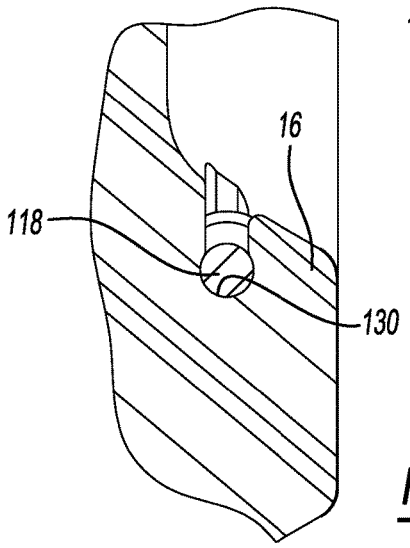
Figure 7A:
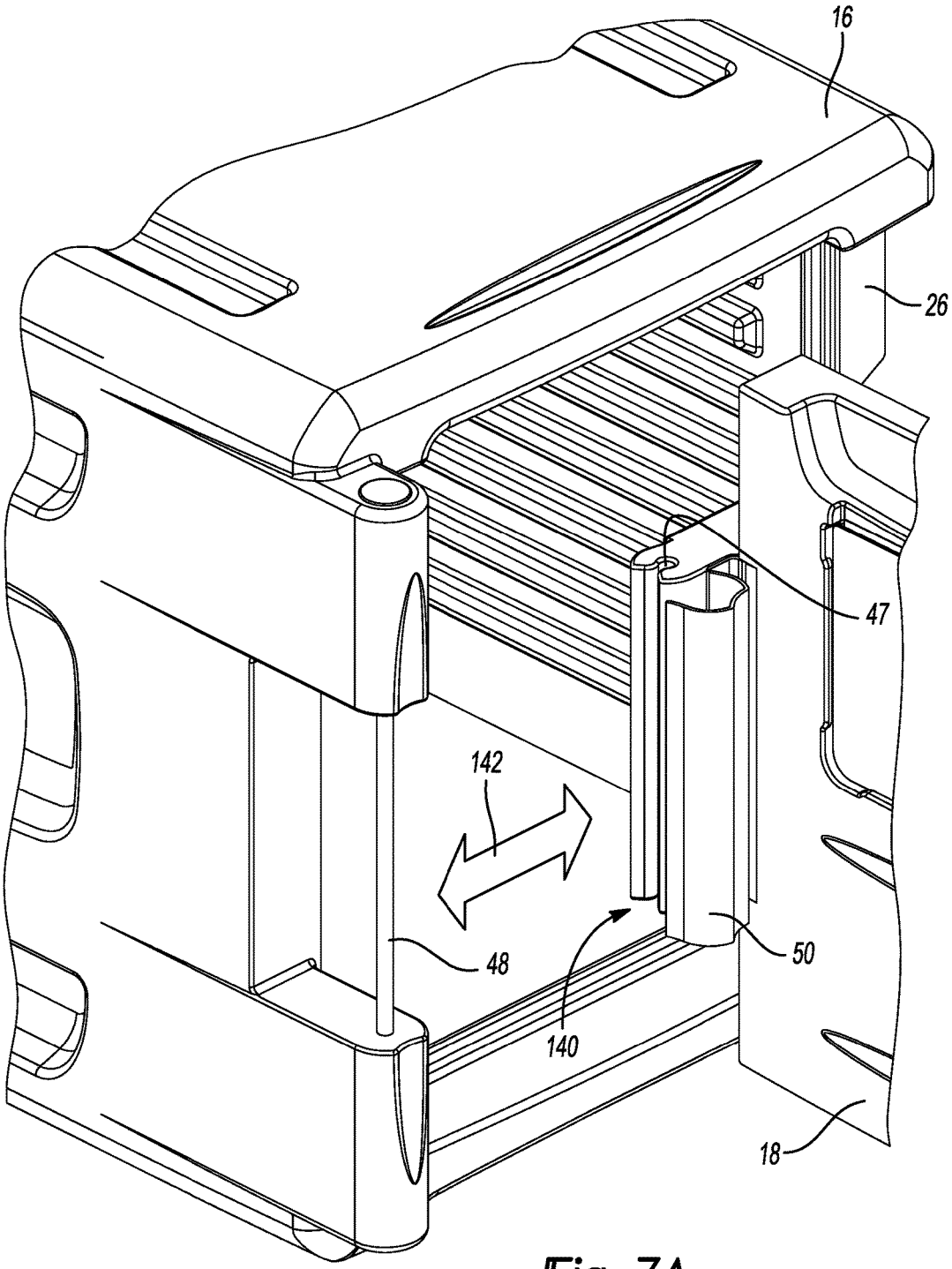
Figure 7B:
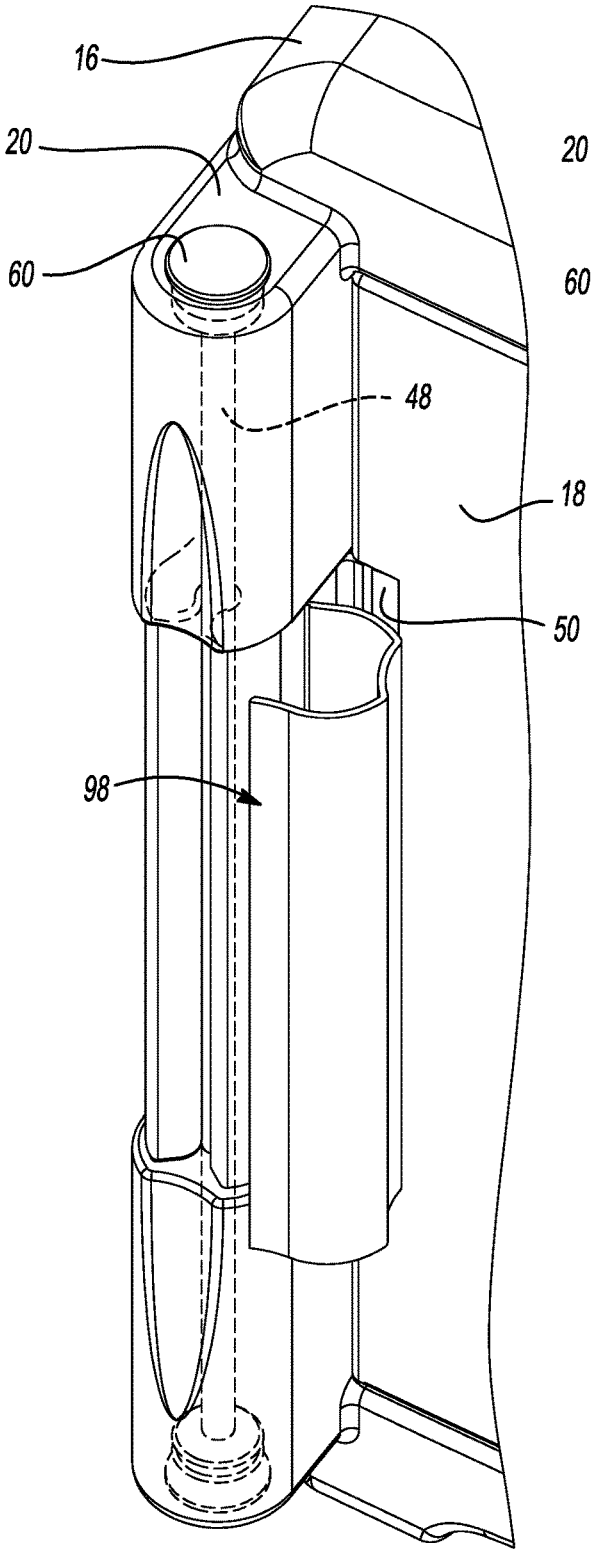
Figure 7C:
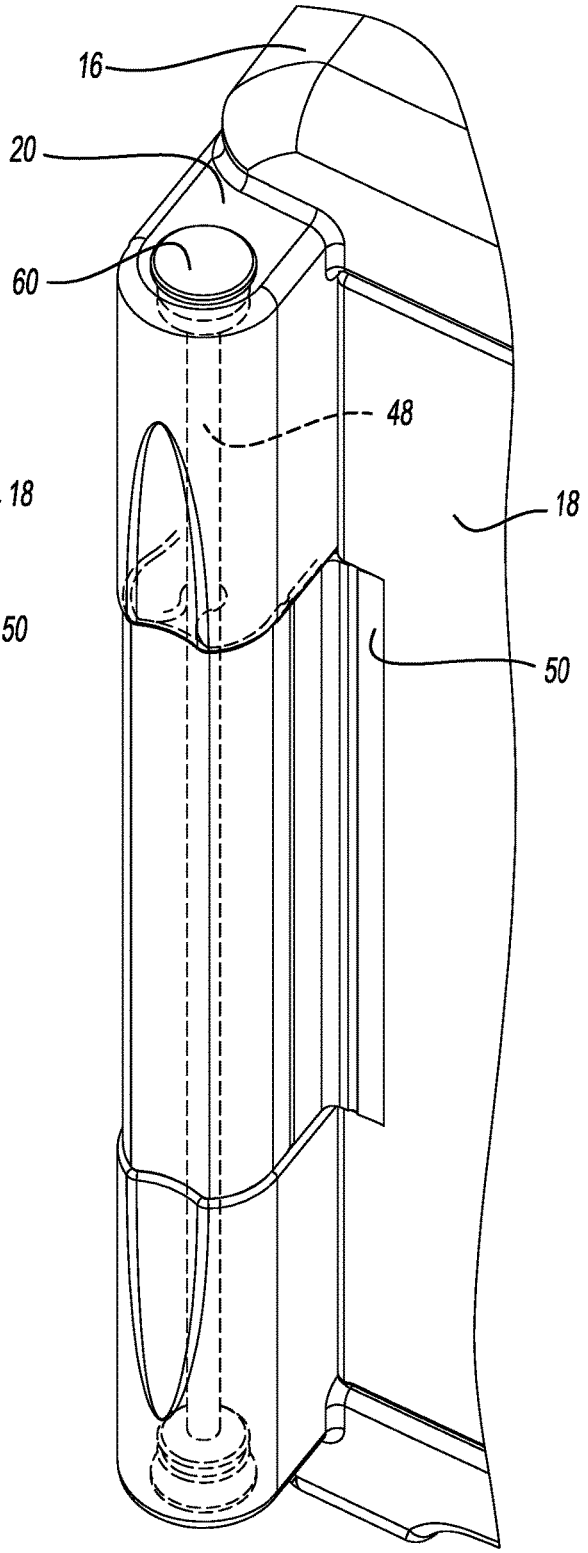

FIGS. 5A-5G show a sealing structure of the cabinet; FIG. 5A is a front right partial perspective view showing a door pivoted about 3° from the closed position; FIG. 5B is a side partial cross sectional view of the sealing structure of FIG. 5A taken at line 5B-5B of FIG. 5A showing the door pivoted about 3° from the closed position; FIG. 5C is a side partial cross sectional view of the sealing structure of FIG. 5A taken at line 5B-5B of FIG. 5A showing the door in the closed position; FIG. 5D is a partial top view of the door; FIG. 5E is a left back partial perspective view of the door; FIG. 5F is a right back partial perspective view showing a back surface of the door in the open position; FIG. 5G is a right front partial perspective view showing a front of a housing;

FIGS. 6A-6C show a latch of the cabinet; FIG. 6A is a front right partial perspective view; FIG. 6B is a back right partial perspective view; FIG. 6B is a top partial cross sectional view taken at line 6C-6C of FIG. 6B; and FIGS. 7A-7C show a method of assembling or disassembling the cabinet; FIG. 7A is a front left partial perspective view showing assembly of the door to a hinge pin; FIG. 7B is a front right partial perspective view showing a hinge cover in an open position; and FIG. 7C is a front right partial perspective view showing the hinge cover in the closed position.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Insulated transport cabinets for food and the like may be used in a variety of applications. Certain applications (e.g., room-to-room food delivery in a hospital or hotel) require frequent opening and closing of the door to access contents of the cabinet. Thus, hinge and latch must be robust and capable of withstanding repeated use.

Some transport cabinets employ slip hinges to pivotally connect a door and a housing of the cabinet. Slip hinges are susceptible to damages through the course of normal use. For example, the hinges often become broken or bent.

Insulated cabinets can also employ a thermal seal, for example, a compressible gasket or a labyrinth seal. Compressible gaskets typically become damaged or worn through frequent use. In some situations, compressible gaskets may fall off or otherwise disengage the carrier as a result of use. Labyrinth seals are less effective than gasket seals in providing insulation. Furthermore, they are not liquid-tight and are therefore ineffective at containing spills inside the carrier. Compressible gaskets and labyrinth seals work when they are compressed by the door. Thus, they prevent the door from staying closed without a latch. Certain carriers are made from expanded polypropylene (EPP). These carriers may utilize the inherent compressibility of EPP to the door with a tight or interference fit. However, doors on this style of EPP carriers may be difficult to open and close.

Insulated cabinets also include latches, such as over-center draw latches, to hold the door in the closed position and engage the seal or gasket. Over-center draw latches may be awkward to use and can create pinch points. Furthermore, these latches are prone to damage such as breakage through repeated use.

Figure 1:
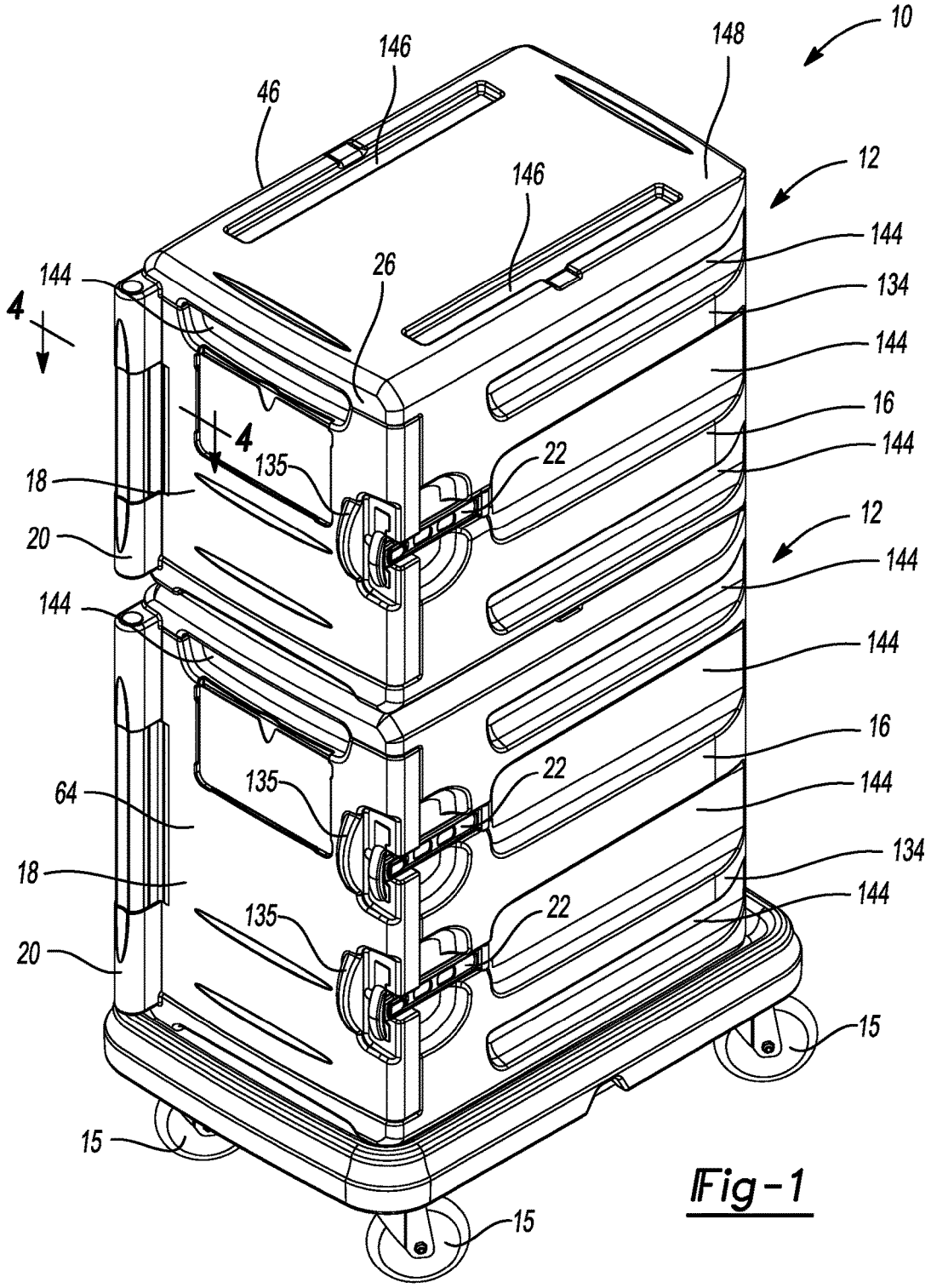
FIG. 1 is a front right perspective view of an insulated transport cabinet according to the principles of the present disclosure.

The present disclosure provides an insulated transport cabinet and a mounting and sealing structure for an insulating transport cabinet. The mounting and sealing structure includes a hinge and a seal between a door and a housing of the cabinet. With reference to FIG. 1, an insulated transport cabinet or carrier 10 for food and the like is provided. The insulated transport cabinet 10 can include one or more cabinet sections 12 and a cart 14. The cart 14 includes a plurality of wheels 15.

Figure 2:
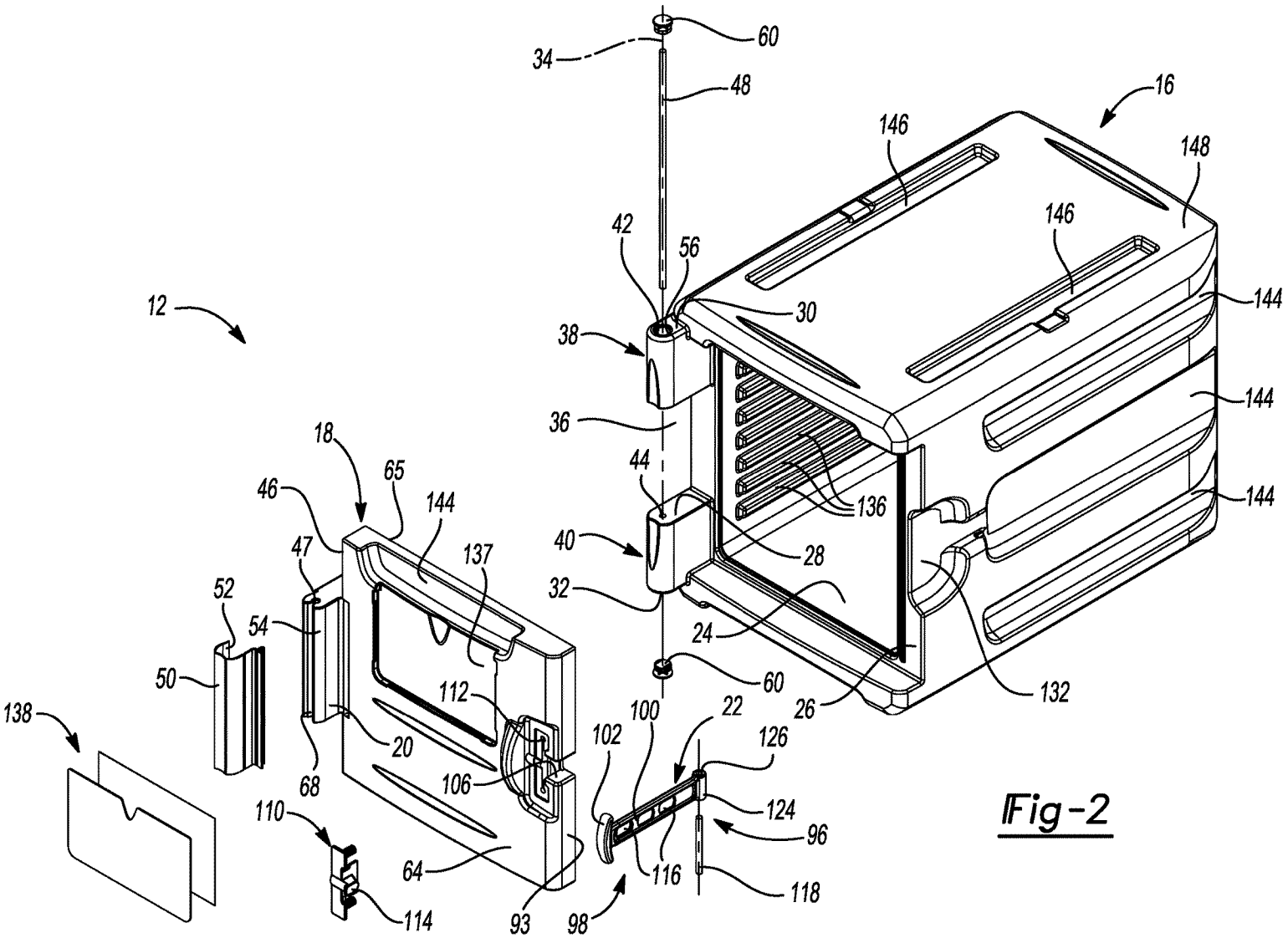
FIG. 2 is a front right exploded perspective view of a cabinet section of the insulated transport cabinet of FIG. 1.
Figure 3:
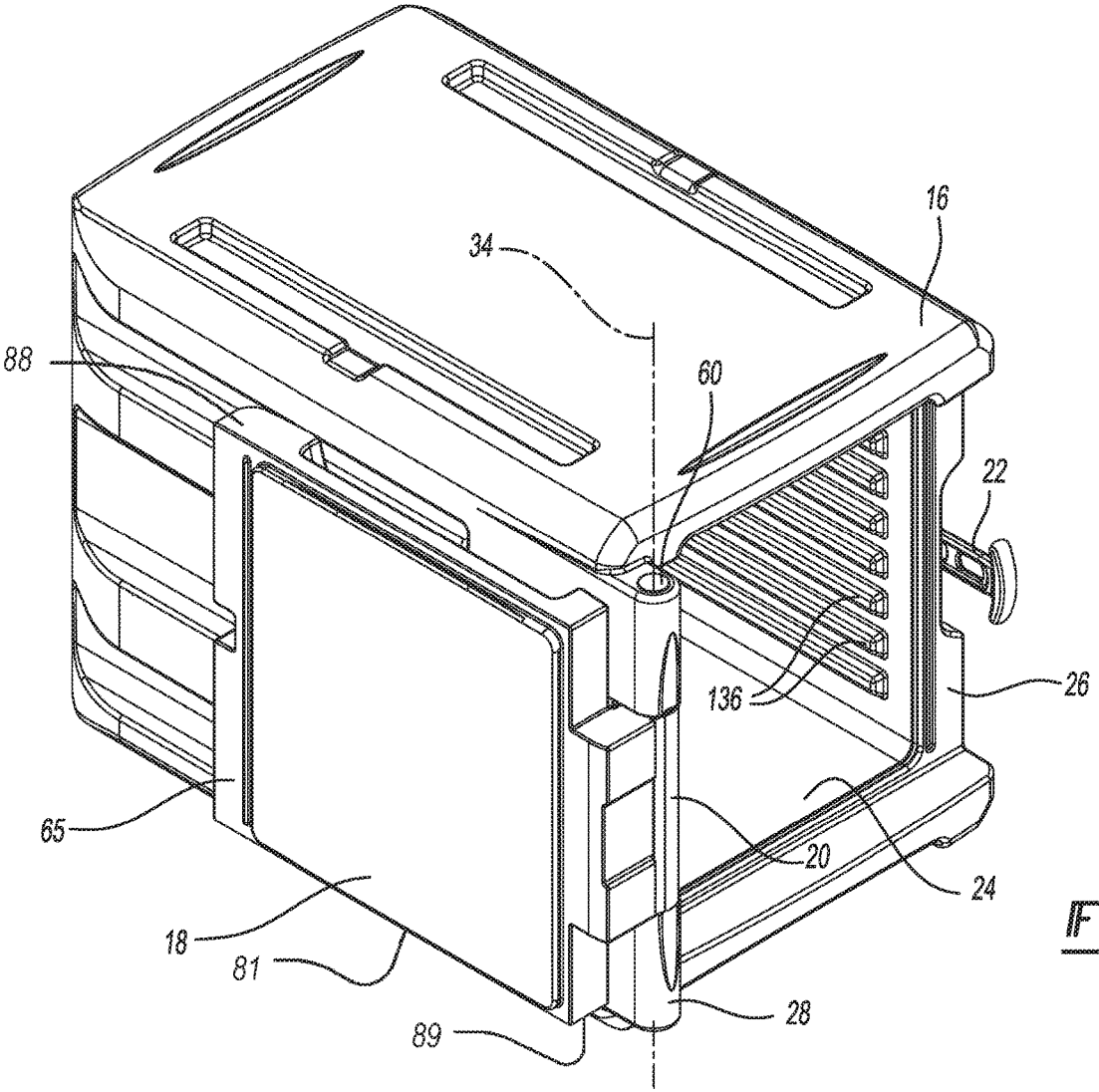
FIG. 3 is a front left perspective view of the cabinet section of FIG. 2 in the open position.

Referring now to FIGS. 2-3, each cabinet section 12 includes a housing or body 16 and a door 18. The door 18 is pivotally connected to the housing 16 by a hinge 20. The door 18 can be secured in the closed position by a latch 22. The door 18 is configured to pivot up to about 270° between the closed position (shown in FIG. 1) and the open position (shown in FIG. 3). An interior compartment 24 of the cabinet section 12 is accessible when the door 18 is in the open position.

The housing 16 includes a front surface 26. The interior compartment 24 extends into the front surface 26. The housing 16 further includes a barrel portion 28 adjacent to the front surface 26. The barrel portion 28 may be integrally formed with the front surface 26. The barrel portion 28 extends between a top end 30 and a bottom end 32. The barrel portion 28 includes a first longitudinal axis 34 extending through its center. The barrel portion 28 further includes a gap 36 located intermediate the top end 30 and the bottom end 32. The gap 36 separates the barrel portion 28 into a top barrel section 38 and a bottom barrel section 40. The top barrel section 38 includes a first passageway 42. The first passageway 42 is substantially aligned with the first longitudinal axis 34. The bottom barrel section 40 includes a second passageway 44. The second passageway 44 is substantially aligned with the first longitudinal axis 34.

The hinge 20 is adjacent to a left side surface 46 of the door 18. The hinge 20 may be integrally formed with the door 18. The hinge 20 includes a third passageway 47. The third passageway 47 is substantially aligned with the first longitudinal axis 34. A hinge pin 48 passes through the first passageway 42, the third passageway 47, and the second passageway 44 to pivotally connect the door 18 to the housing 16.

Figure 4:
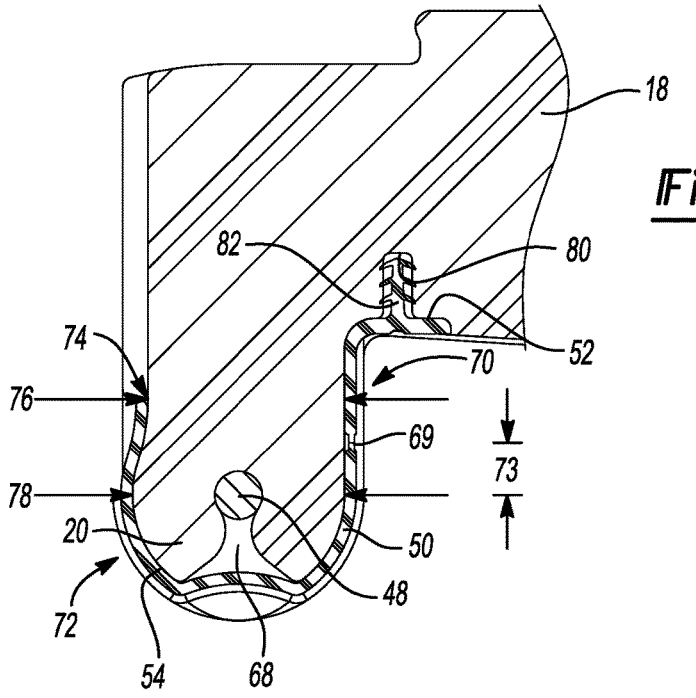
FIG. 4 is a top cross-sectional view of a hinge of the cabinet taken at line 4-4 of FIG. 1.

The cabinet section 12 further includes a hinge cover 50. As best shown in FIG. 4, the hinge cover 50 is fixed to the door 18. The hinge cover 50 has an inner surface 52 that is adapted to complement an outer surface 54 of the hinge 20.

Returning to FIGS. 2-3, the first and second passageways 42, 44 may include counterbores 56. Caps 60 may at least partially engage the counterbores 56 to prevent the hinge pin 48 from backing out of the respective barrel section 38, 40.

The door 18 includes a front surface 64 and a back surface 65. The front surface 64 and the back surface 65 are substantially parallel. The door 18 further includes a center plane 66 (shown in FIG. 5C) disposed between the front surface 64 and the back surface 65. The center plane 66 is substantially parallel to the front surface 64 and the back surface 65. The first longitudinal axis 34 is outside the center plane of the door 18. Thus, there is an offset 67 (shown in FIG. 5C) between the center plane 66 and the axis of rotation, the first longitudinal axis 34, of the door 18.

With reference to FIG. 4, the hinge 20 may also include a slot 68 formed in the outer surface 54 of the hinge 20. The slot 68 may be adjacent to the third passageway 47 and substantially parallel to the first longitudinal axis 34. The slot 68 may overlap an edge of the third passageway 47 so that the slot 68 and the third passageway 47 are connected. Thus, the third passageway 47 may not be fully enclosed. Engagement of the inner surface 52 of the hinge cover 50 with the outer surface 54 of the hinge 20 can enclose the slot 68 to maintain the door 18 on the hinge pin 48.

The hinge cover 50 may include a living hinge 69 disposed between a fixed portion 70 of the hinge cover 50 and a free portion 72 of the hinge cover 50. There may be an offset 73 between the living hinge 69 and the first longitudinal axis 34. More specifically, the living hinge 69 may be disposed between the front surface 64 of the door 18 and the first longitudinal axis 34. The free portion 72 of the hinge cover 50 is adapted to pivot about the living hinge 69 between a locked position and an unlocked position. An outer portion 74 of the hinge cover 50 may be shaped to snap onto the hinge 20 and maintain the hinge cover 50 in the locked position, creating an over-center snap fit. In one example, a first width 76 of the outer surface of the hinge 20 at the outer portion 74 of the hinge cover 50 may be less than a second width 78 of the outer surface of the hinge 20 at the first longitudinal axis 34. Thus, the hinge cover 50 may be held in the locked position.

The hinge cover 50 may be fixed to the door 18. The front surface 64 of the door 18 may include a receiver 80 and the hinge cover 50 may include a protrusion 82 engaging the receiver 80 to fix the hinge cover 50 to the door 18. By way of non-limiting example, the protrusion 82 may have a tree-shape such that branches of the tree maintain the protrusion 82 in the receiver 80. However, other shapes of protrusions 82 and receivers 80 are contemplated within the scope of the present disclosure.

Referring to FIGS. 5A-5G, the cabinet section 12 may also include a sealing structure 83 between the door 18 and the housing 16. The sealing structure 83 may isolate the interior compartment 24 from the outside environment to provide better insulation. In certain aspects, the sealing structure 83 may also provide a fluid barrier. In still other aspects, the sealing structure 83 may help maintain the door 18 in the closed position.

The sealing structure 83 may include a first rib 84 configured to engage a first groove 85. The first groove 85 may extend into a peripheral wall 86 of the interior compartment 24 of the housing 16. The first rib 84 may extend around a perimeter of the door 18 adjacent to the back surface 65 of the door 18. The first rib 84 is configured to engage the first groove 85 when the door 18 is in the closed position. The first rib 84 is configured to disengage the first groove 85 when the door 18 is in the open position.

Referring now to FIGS. 5D-5E, The first rib 84 may include a top rib 87 adjacent to a top surface 88 of the door 18, a bottom rib 81 (which is a mirror image of the top rib 87) adjacent to a bottom surface 89 (best seen in FIG. 3) of the door 18, and a first side rib 89 adjacent to the left side surface 46 of the door 18. Each of the top rib 87, the bottom rib, and the first side rib 89 includes a width 90 and a height 91 (best shown on FIG. 5B) substantially perpendicular to the width 90. The width 90 may be tapered such that it is greater at a center portion than at opposing end portions. The height 91 may be tapered such that it is greater at a center portion than at opposing end portions. Both the width 90 and the height 91 may be tapered. A corner of the perimeter of the door 18 may include a flat portion 92 disposed between the top rib 87 and the first side rib 89.

In some embodiments, the first rib 84 does not extend to an area adjacent to a right side surface 93 of the door 18. With reference to FIGS. 5F-5G, the sealing structure 83 may further include a second rib 94 and a second groove 95. The second rib 94 is included in the back surface 65 of the door 18. The second rib 94 may be vertical or parallel to the right side surface 93 of the door 18. The second groove 95 is included in the front surface 26 of the housing 16. The second groove 95 may be sized and shaped to complement the second rib 94. The second rib 94 engages the second groove 95 when the door 18 is in the closed position.

A combination of the sealing structure 83 geometry and the hinge 20 geometry enables quick disengagement of the first rib 84 from the first groove 85. With respect to the sealing structure 83, the tapered shape of the top 87, bottom, and first side 89 ribs and complementary shape of the first groove 85 allows for easy engagement and disengagement as the door 18 is closed and opened. The flat portion 92 enables quick disengagement with minimal resistance near the first longitudinal axis 34 (i.e., the axis of rotation of the door 18). The placement of the second rib 94 and the second groove 95 in the back surface 65 of the door 18 and the front surface 26 of the housing 16, respectively, similarly minimizes resistance to opening and closing the door. With respect to the hinge 20, the offset 67 from the first longitudinal axis 34, enables quicker disengagement of the first rib 84 from the first groove 85 as the door is opened than if the rotational axis of the door 18 were aligned with the center plane of the door 18. Thus, the first rib 84 may disengage the first groove 85 when the door 18 is pivoted greater than or equal to about 5°, optionally greater than or equal to about 3°, between the closed and the open positions. The door 18 may be opened and closed with very little drag and therefore minimal operator effort.

Because the sealing structure 83 operates without significant compression, it is functional as soon as the door is in the closed position, whether or not the latch 22 (shown in FIG. 1) is used. Furthermore, because the sealing structure 83 is integral to the cabinet section 12, it cannot fall off or become disengaged with the cabinet section 12. The sealing structure 83 may be effective in both providing insulating and creating a barrier to fluid leaks.

Referring now to FIGS. 6A-6C, the cabinet section 12 includes the latch 22 to maintain the door 18 in the closed position. The latch 22 may be moved between a locked position and an unlocked position when the door 18 is closed. The latch 22 includes a fixed end 96 pivotally connected to the housing 16 and a free end 98 configured to engage and disengage the door when the latch 22 is in a locked or unlocked position, respectively. The latch 22 further includes a stem 100 extending between the fixed end 96 and the free end 98. The latch 22 also includes a holder 102 adjacent to the free end 98. The stem 100 and holder 102 may be integrally formed and may have a T-shaped profile so that the holder 102 is substantially perpendicular to the stem 100.

The right side surface 93 of the door 18 is opposite the left side surface 46 and substantially perpendicular to the left side surface 46. The right side surface 93 of the door 18 may include a latch slot 106. The stem 100 of the latch 22 is at least partially disposed in the latch slot 106 when the latch 22 is in a locked position. A back surface 108 of the holder 102 engages the front surface 64 of the door 18 when the latch 22 is in the locked position. Engagement of the back surface 108 of the holder 102 with the front surface 64 of the door 18 maintains the door 18 in the closed position.

The cabinet section 12 may also include a latch keeper 110. The latch keeper 110 may be fixed to the front surface 64 of the door 18. More specifically, the latch keeper 110 may be at least partially disposed within a recessed portion 112 of the front surface 64 of the door 18. The latch keeper 110 may include an extension 114 adapted to engage a receptacle 116 in the stem 100 of the latch 22. Engagement of the extension 114 with the receptacle helps maintain the latch 22 in the locked position. The latch 22 may include a plurality of receptacles 116.

The latch 22 may comprise an elastomeric material. In certain aspects, the latch 22 may be stretched or energized as it is placed into a locked position. The elasticity of the latch 22 enables the holder 102 to apply a force to the door 18 to hold the door 18 in the closed position. The elastomeric material is resilient to repeated use and less susceptible to breakage than compared to certain other latches, such as over-center draw latches.

The latch 22 may be pivotally connected to the housing 16 by a latch pin 118. The latch pin 118 may include first and second ends 120, 122 that are fixed to the housing 16. The latch 22 may further include a tubular portion 124 adjacent to the fixed end 96. The tubular portion 124 may include a passage 126 (shown in FIG. 2) extending along a second longitudinal axis 128. The latch pin 118 may pass through the passage 126 so that it is substantially aligned with the second longitudinal axis 128. The latch 22 is adapted to pivot about the second longitudinal axis 128 between the unlocked position and the locked position. With reference to FIG. 6C, the housing 16 may further include an undercut 130. The undercut 130 may be shaped to complement the latch pin 118. The first and second ends 120, 122 of the latch pin 118 may engage the undercut 130 to maintain the latch pin 118 in the housing 16. The latch 22 may be disposed in a pocket 132 included in a right side surface 134 of the housing 16.

Returning now to FIG. 1, an insulated transport cabinet 10 may include multiple cabinet sections 12. The cabinet sections 12 may be different sizes, or they may be uniformly sized (not shown). Each cabinet section 12 may include one or more handles 135 that can be used by an operator to open and close the door 18 to access the interior compartment 24 (shown in FIG. 2). Each cabinet section 12 may also include multiple latches 22 and associated components (e.g., latch keeper 110, latch pin 118), and geometry (e.g., latch slot 106, recessed portion, pocket 132). As shown in FIGS. 2-3, the interior compartment 24 may include a plurality of opposing ridges 136. The plurality of opposing ridges 136 is configured to permit insertion and removal of shelves or trays (not shown). The door 18 may include a rectangular recess 137 for a label holder 138

With reference to FIGS. 7A-7C, the present disclosure also provides a method of assembling the insulated transport cabinet 10. The housing 16 may be provided with the latch 22 and hinge pin 48 in place. Referring to FIG. 7A, the door 18 may be oriented at a 90° angle to the front surface 26 of the housing 16. The hinge cover 50 may be in the unlocked position. Thus, an open side 140 of the hinge 20 comprising the third passageway 47 and the slot 68 is oriented toward the hinge pin 48. The door 18 is translated in the direction shown at 142 until the third passageway 47 of the hinge 20 is disposed around the hinge pin 48, as shown in FIG. 7B. The free end 98 of the hinge cover 50 is snapped over the hinge 20, as shown in FIG. 7C. Thus, the hinge cover 50 is changed from the unlocked to the locked position. In the locked position, the hinge cover 50 maintains the door 18 on the housing 16. The door 18 may be easily removed from the housing 16 by reversing the method steps described above.

Returning now to FIGS. 1-2, multiple cabinet sections 12 may be stacked on top of one another. The cabinet sections 12 may be stacked on top of the cart 14 to assemble the insulated transport cabinet 10. The cabinet section 12 may include one or more grooves or handles 144 for lifting, moving the cabinet sections 12. The handles may be provided in a back surface of the housing 16 (not shown), the side surfaces 46, 132 of the housing 16, the front surface 26 of the housing 16, or the front surface 64 of the door 18.

A pair of grooves 146 may be included in a top surface 148 of the housing 16. A pair of ribs shaped to complement the pair of grooves 146 may extend from a bottom surface of the housing 16 (not shown). The pair of ribs of the bottom surface of one cabinet section 12 engages the pair of grooves 146 of the top surface of another cabinet section 12 to maintain the cabinet sections 12 on top of one another and prevent shifting and sliding. Similar ribs and grooves may be provided between a bottom cabinet section 12 and the cart 14 to maintain the cabinet section 12 on the cart 14 during transport. Although the insulated transport cabinet 10 described herein makes reference to left and right sides, it should be understood that the features of each side can be reversed within the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A door mounting and sealing structure for an insulated transport cabinet, the door mounting and sealing structure comprising:
- a housing comprising:
  - an interior compartment having a peripheral wall; and
  - a first groove extending into the peripheral wall; and
- a door attached to the housing and moveable between an open position and a closed position, the door comprising:
  - a first side surface, a second side surface opposite the first side surface, and a back surface substantially perpendicular to the first side surface and the second side surface;
  - a hinge adjacent to and integrally formed with the first side surface, the hinge pivotally attaching the door to the housing; and
  - a first rib disposed around at least a portion of a perimeter of the door adjacent to the back surface, the first rib shaped and sized to engage the first groove of the housing when the door is in the closed position, wherein:
- a cross-section of the first rib taken transverse to a length of the first rib is tapered along the length of the first rib and at least a cross-sectional height of the first rib is greater at a lengthwise center portion of the first rib than at opposing lengthwise end portions of the first rib.

2. The door mounting and sealing structure of claim 1, wherein the first rib comprises a top rib disposed adjacent to a top surface of the door, a bottom rib disposed adjacent to a bottom surface of the door, and a first side rib disposed adjacent to the first side of the door.

3. The door mounting and sealing structure of claim 2, wherein a cross-section of each of the top rib, the bottom rib, and the first side rib taken transverse to a respective length of each of the top rib, the bottom rib, and the first side rib is non-uniform along the respective length of each of the top rib, the bottom rib and the first side rib.

4. The door mounting and sealing structure of claim 3, wherein both of a cross-sectional width and a cross-sectional height of each of the top rib, the bottom rib, and the first side rib is greater at a lengthwise center portion of each of the top rib, the bottom rib, and the first side rib than at opposing lengthwise end portions of each of the top rib, the bottom rib, and the first side rib.

5. The door mounting and sealing structure of claim 2, wherein a corner of the perimeter of the door adjacent to the top surface and the first side surface includes a flat portion located between the top rib and the first side rib.

6. The door mounting and sealing structure of claim 1, wherein:
- a front surface of the housing includes a second groove and the back surface of the door includes a second rib sized and shaped to complement the second groove;
- the second rib is substantially parallel to the second side surface of the door and is disposed adjacent to the second surface of the door; and
- the second rib engages the second groove when the door is in the closed position.

7. The door mounting and sealing structure of claim 1, wherein the first groove and the first rib are configured to create a fluid-tight seal when the door is in the closed position to prevent fluid leaks.

8. The door mounting and sealing structure of claim 1, wherein:

the housing further comprises:

a barrel portion adjacent to a front surface of the housing and extending between a top end and a bottom end, the barrel portion comprising:

a longitudinal axis extending through a center of the barrel portion;

a gap located intermediate the top end and the bottom end, the gap separating the barrel portion into a top barrel section and a bottom barrel section;

a first passageway in the top barrel section, the first passageway substantially aligned with the longitudinal axis; and a second passageway in the bottom barrel section, the second passageway substantially aligned with the longitudinal axis, wherein:

the hinge further comprises a third passageway substantially aligned with the longitudinal axis;

a hinge pin passes through the first passageway, the third passageway, and the second passageway; and the door is adapted to pivot about the longitudinal axis to move between the open position and the closed position.

9. The door mounting and sealing structure of claim 8, wherein the door includes a center plane disposed between the back surface of the door and a front surface of the door, the center plane is substantially parallel to the front surface and the back surface, and the longitudinal axis is offset from the center plane.

10. The door mounting and sealing structure of claim 9, wherein the first rib of the door and the first groove of the housing are fully disengaged when the door is pivoted greater than or equal to about 3° about the longitudinal axis from the closed position.

11. The door mounting and sealing structure of claim 8, further comprising a latch comprising:

a fixed end pivotally connected to the housing;

a free end;

a stem extending between the fixed end and the free end; and a holder adjacent to the free end;

wherein the latch is adapted to pivot between an unlocked position and a locked position; and wherein the stem of the latch is at least partially disposed in a latch slot, and a back surface of the holder engages a front surface of the door when the latch is in a locked position to maintain the door in the closed position.

* * * * *